US006935425B2

(12) United States Patent
Aronstam

(10) Patent No.: US 6,935,425 B2
(45) Date of Patent: Aug. 30, 2005

(54) METHOD FOR UTILIZING MICROFLOWABLE DEVICES FOR PIPELINE INSPECTIONS

(75) Inventor: Peter S. Aronstam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 168 days.

(21) Appl. No.: 10/224,815

(22) Filed: Aug. 21, 2002

(65) Prior Publication Data

US 2003/0056607 A1 Mar. 27, 2003

Related U.S. Application Data

(63) Continuation-in-part of application No. 09/578,623, filed on May 25, 2000, now Pat. No. 6,443,228.

(60) Provisional application No. 60/136,656, filed on May 28, 1999, and provisional application No. 60/147,427, filed on Aug. 5, 1999.

(51) Int. Cl.[7] ..... G01M 19/00; G01N 33/00; E21B 47/00; E21B 49/00

(52) U.S. Cl. ..... 166/250.11; 166/66; 175/40; 73/152.28; 73/61.41; 73/865.8; 73/866.5

(58) Field of Search ..... 166/66, 72, 250.01, 166/250.11, 255.1, 381; 175/40, 44, 45, 46, 48, 50; 73/152.55, 152.28, 152.02, 865.8, 623, 61.41, 866.5

(56) References Cited

U.S. PATENT DOCUMENTS

| | | | | |
|---|---|---|---|---|
| 3,260,112 A | * | 7/1966 | Godbey et al. | 374/104 |
| 3,961,493 A | | 6/1976 | Nolan, Jr. et al. | 61/72.3 |
| 4,120,313 A | | 10/1978 | Lewis | 137/268 |
| 4,691,572 A | | 9/1987 | van den Berg et al. | 73/643 |
| 4,799,552 A | | 1/1989 | Acree | 166/305.1 |
| 5,461,313 A | | 10/1995 | Bohon et al. | 324/240 |
| 5,485,148 A | * | 1/1996 | Tseng | 340/10.41 |
| 5,675,251 A | | 10/1997 | MacLean et al. | 324/220 |
| 5,956,135 A | | 9/1999 | Quesnel | 356/241 |
| 5,991,602 A | * | 11/1999 | Sturm | 455/40 |
| 6,196,075 B1 | | 3/2001 | Comello et al. | 73/865.8 |
| 6,234,257 B1 | * | 5/2001 | Ciglenec et al. | 175/50 |
| 6,241,028 B1 | | 6/2001 | Bijleveld et al. | 175/40 |
| 6,243,657 B1 | | 6/2001 | Tuck et al. | 702/150 |
| 6,324,904 B1 | | 12/2001 | Ishikawa et al. | 73/152.03 |
| 6,443,228 B1 | * | 9/2002 | Aronstam et al. | 166/250.11 |

* cited by examiner

*Primary Examiner*—Jennifer Gay
(74) *Attorney, Agent, or Firm*—Madan, Mossman & Sriram, P.C.

(57) ABSTRACT

Microflowable devices can be used in pipelines to perform inspections. Disclosed are methods of using microflowable devices to measure parameters of interest within a pipeline to inspect the pipeline for conditions such as stress, corrosion, wall erosion and the like. Also disclosed is performing maintenance on the pipeline to correct such conditions.

20 Claims, 1 Drawing Sheet

METHOD FOR UTILIZING MICROFLOWABLE DEVICES FOR PIPELINE INSPECTIONS

CROSS-REFERENCE TO RELATED APPLICATIONS

This application takes priority from U.S. Pat. application Ser. Nos. 09/578,623 filed May 25, 2000, now U.S. Pat. No. 6,443,228 B1, 60/136,656 filed May 28, 1999, and 60/147,427 filed Aug. 5, 1999, each assigned to the assignee of this application.

BACKGROUND OF THE INVENTION

1. Field of the Invention

This invention relates to pipelines and more particularly to methods for the inspection of pipelines.

2. Background of the Art

Pipelines are widely used in a variety of industries, allowing a large amount of material to be transported from one place to another. A variety of fluids, such as oil and/or gas, as well as particulate, and other small solids suspended in fluids, are transported cheaply and efficiently using underground pipelines. Pipelines can be subterranean, submarine, on the surface of the earth, and even suspended above the earth. Subterranean and submarine pipelines especially carry enormous quantities of oil and gas products indispensable to energy-related industries, often under tremendous pressure and at high temperature and at high flow rates.

Unfortunately, even buried pipelines are not completely protected from the elements. Corrosion of a pipeline can cause small spots of weakness, which if not detected and fixed, could result in a pipeline catastrophe. Subsidence of the soil, local construction projects, seismic activity, weather, and simply wear and tear from the friction of fluids passing through a pipeline can lead to defects and anomalies in the pipeline. Shifts in the pipeline location can also lead to defects, cracks, leaks, bumps, and other anomalies, within the interior of the pipeline.

Both the internal and external surface of a pipeline can be damaged by environmental factors such as the reactivity of the material flowing through the pipeline, the pressure, temperature and chemical characteristics of various products and contaminants inside and outside the pipeline, corrosion, mechanical damage, fatigue, crack, stress, corrosion cracks, hydrogen induced cracks, distortion due to dents or wrinkles, exposure, and damage to weight coating and free spanning of offshore pipelines. Moreover, submarine pipelines face a hostile environment of ships anchors, troll boards and seabed scouring due to strong currents. Although timely repair or maintenance of pipelines can lengthen the service lifetime of the pipeline, a rupture or serious leak (also referred to as failure) within the pipeline can be difficult and expensive to repair and can be difficult to locate.

The cost to industry as well as the potential for damages to human life from a pipeline failure can be great. A pipeline can be adversely affected by the anomalies that may lead to failure long before a failure occurs. Consequently, industry has produced various inspection devices for detecting defects and anomalies. For example, it is known to use a pipeline inspection apparatus that includes a vehicle capable of moving along the interior of the pipe by the flow of fluid through the pipe to inspect the pipe for location of anomalies. Such prior inspection vehicles or "pigs" have typically included various means of urging the pigs along the interior of the pipe including rubber seals, tractor treads, and even spring-loaded wheels. In the case of the latter, the pigs have further included odometers that count the number of rotations of the wheels. Various measurements have been made with pigs using wipers or even the wheels of pigs having wheels. The wipers or wheels of pigs have included devices such as ultrasound receivers, odometers, calipers, and other electrical devices for making measurements. For example, a has been used to record shape of the pipeline according to the ultrasonic signature received by ultrasonic transducers, each data sample associated with an odometer measurement.

Other related pipeline inspection technologies have included the use of measurement devices such as ultrasonic transducers mounted on an inspection unit within the pig that emit high frequency sound and measure and record the reflected and refracted signals from the walls of the pipe. However, the use of pigs, while well known and generally dependable, is not without its problems. For example, a pig, depending upon its purpose, can significantly reduce the flow of materials through a pipeline while the pig is present therein. Even more undesirable is the possibility that a pipeline has become so narrowed or blocked that a pig can be lost within a pipeline and require a reverse flush of the pipeline, or even more drastic measures, to retrieve it. In some applications, a pipeline must be shutdown completely during pigging operations. Most pipelines are privately operated and any loss in production, including loss of production due to downtime for pigging operations, can be costly.

The present invention provides systems and methods wherein discrete microflowable devices are utilized to measure and record pipeline parameters of interest relating to the pipeline systems.

SUMMARY OF THE INVENTION

In one aspect, the present invention is a method for utilizing microflowable devices for pipeline inspections comprising: a) injecting at least one microflowable device into a pipeline containing a moving fluid, b) allowing the at least one microflowable device to pass through a portion of the pipeline, collecting data regarding a parameter of interest relating to the pipeline, and (c) recovering the data regarding the parameter of interest.

In another aspect, the present invention is a pipeline inspection system including a pipeline, a microflowable device, and an injection point, wherein the microflowable device is capable of collecting data regarding a parameter of interest.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For a detailed understanding of the present invention, reference should be made to the following detailed description of the preferred embodiment, taken in conjunction with the accompanying drawings, in which like elements have been given like numerals, wherein.

DETAILED DESCRIPTION OF THE PREFERRED EMBODIMENT

The present invention utilizes "microflowable devices" in pipelines to perform one or more inspection functions within the pipeline. For the purpose of this disclosure, a microflowable device means a discrete device that is moved by a fluid flowing in the pipeline and is preferably less than 1 cm in its largest dimension. Preferably, the microflowable devices of the present invention have a largest dimension that is less than ten (10) percent of the diameter of the pipeline in which it is being used. Even more preferably the microflowable devices of the present invention have a largest dimension that is less than five (5) percent of the diameter of the pipeline in which it is being used. Most preferably, the microflowable devices of the present invention have a largest dimension that is less than one (1) percent of the diameter of the pipeline in which it is being used.

Specifically, the microflowable device according to this invention is preferably of relatively small size (generally in the few millimeters to a centimeter range in outer dimensions) that can perform a useful function in the pipeline. Such a device may make measurements, sense a parameter, and/or store information. The microflowable device may communicate data and signals with other microflowable devices and/or devices placed in the pipeline. The microflowable device may be programmed or coded with desired information. An important feature of the microflowable devices of the present invention is that they are sufficiently small in size so that they can circulate with the fluid being pumped in the pipeline without impairing the pipeline operations. Such devices preferably can flow with a variety of fluids in the pipeline. The various aspects of the present invention are described below in reference to FIGS. 1 and 2.

In a preferred embodiment, the microflowable device may include one or more of the following: a sensor for collecting data relating to one or more parameters of interest, a memory for storing data and/or instructions, an antenna for transmitting and/or receiving signals and a control circuit. The control circuit or controller can function for processing, at least in part, sensor measurements and for controlling the transmission of data from the device. The microflowable device may include a battery for supplying power to its various components. The microflowable device may also include a power generation device utilizing the turbulence in the pipeline fluid flow to generate power, for example, the so-called piezoelectric generators. The generated power may be utilized to charge the battery in the device or as a sole power source.

Figure 1:
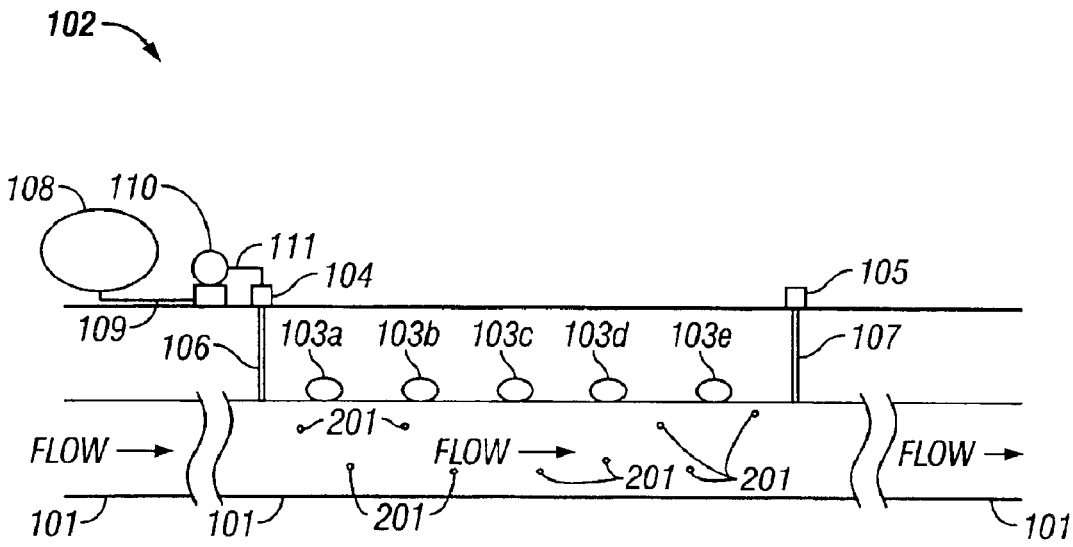
FIG. 1 is a schematic illustration of a pipeline wherein microflowable devices are injected into a moving fluid within a pipeline.

FIG. 1 is a schematic illustration of a pipeline 101, buried in the ground 102, wherein microflowable devices 201 are injected into a moving fluid within the pipeline 101. In this embodiment, the microflowable devices 201 are supplied from a source thereof 108, through a first feed line 109, to a pump or other injection device 110. The injection device 110 supplies the microflowable devices 201, preferably in a fluid that is the same as, or at least compatible with, the fluid being pumped through the pipeline, to an injection site 104 through a second feed line 111. The microflowable devices 201 pass through an injection tube 106 and into the pipeline 101 wherein the flow of the fluid in the pipeline carries the microflowable devices toward an extraction tube 107.

As the microflowable devices 201 travel though the pipeline, they pass devices 103*a–e*, often permanent magnets, which can be used by the microflowable devices 201 to sense location within the pipeline 101. These devices can be preinstalled on the pipeline or else they can be attached temporarily for purposes of the test only. In one embodiment of the present invention, the devices used by the microflowable devices 201 to sense location 103*a–e* are permanent magnets which are augured into the ground and into contact with the pipeline.

Once the microflowable devices 201 reach the area of the extraction tube 107, at least some of the microflowable devices 201 are extracted using any method known to those of ordinary skill in the art to be useful. In one embodiment, a plurality of microflowable devices 201 are injected and a small aliquot of fluid is merely extracted through the extraction tube 107 and collected at the extraction site 105. The aliquot of fluid is then subjected to centrifugation and the microflowable devices separated and analyzed. In another embodiment, a "strainer" or screen (not shown) having a mesh size smaller than the smallest dimensions of the microflowable devices can be used with the method of the present invention. Any method of extraction of the microflowable devices can be used with the method of the present invention. Preferably, the method of extraction of microflowable devices does not significantly reduce the flow rate of fluids in a pipeline 101 during its use.

While recovering the microflowable devices is within the scope of the present invention, the method of the present invention can be practiced without recovering the microflowable devices. The cost of the microflowable devices is preferably so low that they can be discarded, and the size of the microflowable devices is sufficiently small that they can be either trapped downstream in sand filters or even, in the case of hydrocarbons, handled in the refinery equipment designed to accommodate solids which are common in hydrocarbon feed stocks. In the case where none of the microflowable devices are physically recovered from within the pipeline, the data must be collected by another means, for example by means of electromagnetic telemetry.

Figure 2:
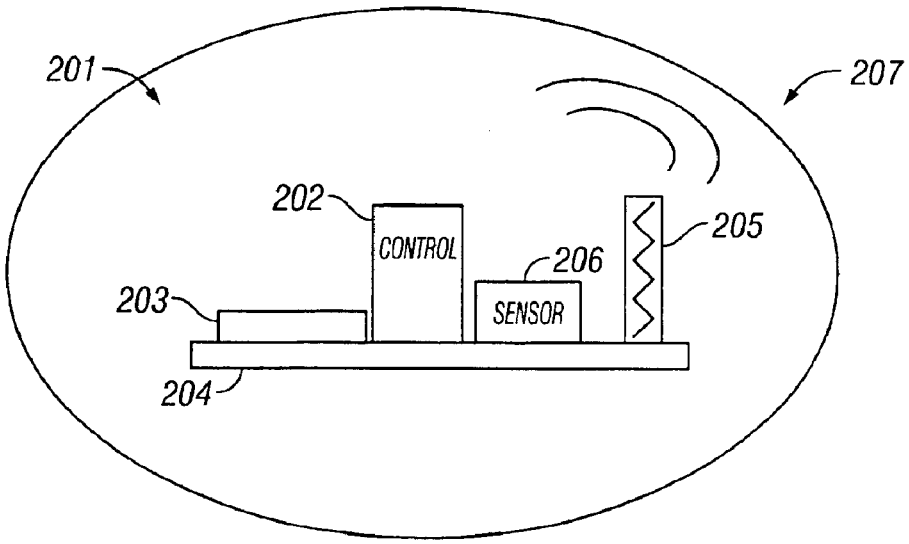
FIG. 2 is a block functional diagram of a microflowable device according to one embodiment of the present invention.

FIG. 2 is a block functional diagram of a microflowable device according to one embodiment of the present invention. The microflowable device 201 is preferably encapsulated in a material 207 that is suitable for the pipeline environment, such as ceramic, and includes one or more sensor elements 206, a control circuit or controller 202 and a memory unit 203. A resident power supply 204 supplies power to the sensor 206, controller 202, memory 203 and any other electrical component of the microflowable device 201. The controller 202 may include a processor that interacts with one or more programs in the microflowable device to process the data gathered by the device and/or the measurements made by the microflowable device to compute, at least partly, one or more parameters of interest, including results or answers.

An example of such a calculation would be one wherein the microflowable device 201 calculates a parameter, change its future function and/or transmit a signal in response to the calculated parameter to cause an action by another microflowable device or another device in or outside of the pipeline. In one embodiment, the microflowable device may determine a detrimental condition, such as a partial blockage and then send a signal to indicate that maintenance of that section of the pipeline is required. The microflowable device may be designed to have sufficient intelligence and processing capability so it can take any number of different actions in the pipeline.

A power generation unit that generates electrical power due to the turbulence in the flow may be incorporated in the microflowable device (not shown) to charge a battery (resident power supply) 204. An antenna 205 is provided to transmit and/or receive electromagnetic signals, thereby providing one-way or two-way communication (as desired) between the microflowable device 201 and another device, which may be a microflowable device or a device located in or outside of the pipeline. The microflowable device 201 may be programmed outside or within a pipeline to carry data and instructions.

A device inside or outside a pipeline can read the data or other information within a microflowable device 201. The microflowable device 201 may transmit and receive signals in the pipeline and thus communicate with other devices. Such a microflowable device 201 can transfer or exchange information with other devices, establish communication link along the pipeline, and establish a communication network in the pipeline. Each such microflowable device may be coded with an identification number or address, which can be utilized to confirm the receipt or transfer of information by the devices deployed to receive the information from the microflowable device 201. In one such method, the microflowable device 201 may be sequentially numbered and introduced into the fluid flow to be received at a target location. If the receiving device receives a microflowable device 201, it can cause a signal to be sent to the sending location, thereby confirming the arrival of a particular device. If the receiving device does not confirm the arrival of a particular microflowable device 201, a second microflowable device 201 carrying the same information and the address may be sent. This system will provide a closed loop system for transferring information between locations.

The microflowable device 201 may include a ballast (not shown) that can be released or activated to alter the buoyancy of the microflowable device 201. Any other method also may be utilized to make the microflowable device with variable buoyancy. Additionally, the microflowable device 201 may also include a propulsion mechanism (not shown) that can be selectively activated to aid the device 201 to move within the flow in the pipeline. The propulsion mechanism may be self-activated or activated by an event such as the location of the microflowable device 201 in the fluid or its speed.

In another aspect of the invention, a microflowable device of the present invention may contain a chemical that undergoes a change of state in response to a parameter, parameter of interest. Other devices, such as devices that contain biological mass or mechanical devices that are designed to carry information or sense a parameter of interest may also be utilized. In yet another aspect, the microflowable device may be a device carrying power, which may be received by a receiving device.

While the foregoing are preferred embodiments of the present invention, simpler versions of the microflowable devices are also within the scope of the present invention, and for some applications even preferred over same. For example, in one embodiment, a microflowable device of the present invention can be a nanowire that interacts with certain ions. Pipelines can, with time build up a coating on the interior surfaces in contact with the fluid being pumped. A stress applied to the pipeline can interrupt that coating exposing metal or other materials used to manufacture the pipeline to the fluids being pumped through the pipeline thereby releasing traces of the pipeline material in the form of ions into the fluid. A nanowire that can interact with such ions could be used to monitor the pipeline fluid for such ions. In this embodiment, a microflowable device would be just the nanowire. In a more preferred embodiment, the microflowable device would be a device similar to that in FIG. 2 wherein the sensor 206 is a nanowire which is either: (1) inserted into the fluid flowing through the pipeline at a time also recorded by the microflowable device 201, or (2) inserted into the fluid flowing through the pipeline at a location sensed by the microflowable device 201 using, for example, the devices used by the microflowable devices to sense location 103*a–e*.

In one particularly preferred embodiment of the method of the present invention, a pipeline is treated with a detection enhancement agent prior to or concurrent with the injection of the microflowable devices. This agent is selected such that it is both attracted to section of pipe having a parameter of interest, such as corrosion, and is easier to detect than the parameter of interest. For example, a chemical agent that selectively adheres to areas having corrosion can be injected into a pipeline. The unbound agent can then be cleared from the pipeline. The bound agent releases with time and would then be detectable by a microflowable device of the present invention. This particular embodiment would be particularly effective with a microflowable device having a nanowire as a detector.

In the practice of the present invention, preferably, a plurality of microflowable devices is injected into the fluid being pumped through a pipeline. The advantages of the method of the present invention is that the microflowable devices are small enough not to disrupt pipeline operations and thus can be used as a continuous monitoring system for a pipeline. This is a significant advantage over conventional systems that can require a continuous communication with strain sensors, corrosion meters, and the like, along the length of the pipeline.

A data exchange device that can read information stored in the microflowable devices of the present invention can be used to both receive data from and impart information or instructions to the microfloable devices of the present invention. An inductive coupling unit or another suitable device may be used as the read/write device. Such information may include instructions for the controller or other electronic circuits to perform a selected function. A controller within a microflowable device of the present invention may include a microprocessor-based circuit that causes the read/write unit to exchange appropriate information with the microflowable devices.

The microflowable devices of the present invention may also be measurement or sensing devices, in that, they may provide measurements of certain parameters of interest such as pressure, temperature, flow rate, viscosity, composition of the fluid, presence of a particular chemical, water saturation, composition, corrosion, vibration, and the like. Any parameter that can be measured by a sensor on or in a microflowable device of the present invention is within the scope of the present invention.

The microflowable devices of the present invention can be used in at least two primary modes. In a first mode, at least some of the microflowable devices injected into a pipeline will have the ability to measure time. Using this feature, an analysis of any data collected by the microflowable devices can be tied to location within a pipeline based upon the flow rate of fluid moving in the pipeline.

In a second mode, the microflowable devices of the present invention have a sensor that can determine the location of the microflowable devices in relation to a magnetic or electromagnetic signal. These signals are preferably provided by devices at known locations along the pipeline, either preinstalled or installed for purposes of the inspection. Using this feature, any data collected by the microflowable devices can be tied to location within a pipeline based upon the proximity of such a signal.

When operating in either mode, the microflowable devices of the present invention can be used for inspections not easily done with other methods. For example, a plurality of microflowable devices of the present invention that can sense pressure changes can be injected into a pipeline to test the pipeline for erosion of the pipeline wall. In this embodiment, the pipeline is held at a constant pressure and the at the point of injection. After injection, the microflowable devices monitor pressure changes and, upon reaching a point where there is a slight drop in pressure, record data relating to location within the pipeline and the pressure drop. Upon recovery, this data is downloaded and analyzed for location and magnitude of pressure drops, such locations being prime candidates as areas of wall erosion.

Another method of doing this same analysis can be performed using microflowable devices that can record location and flow velocity data. In a two pass procedure, a profile of the flow rate of fluids passing through the pipeline is done at a first pressure and then repeated at a substantially higher pressure. Erosion of the wall of the pipeline will allow for greater expansion of the pipeline at higher pressure resulting in a slower flow rate at points of significant pipeline wall erosion.

A particularly preferred embodiment of the present invention is one wherein a a microflowable device having a sensor that can extend and/or expose a nanowire is used to test for pipeline stress. In this embodiment, a plurality of microflowable devices of the present invention is injected into a pipeline wherein the microflowable devices are programmed to extend or expose a nanowire at a predefined point within the pipeline. After collection, the nanowires are analyzed for extent of exposure to specific ions and the extent of exposure is correlated to location within the pipeline. In another embodiment, the microflowable device is programmed to retract and/or withdraw the nanowire from contact with the fluid being pumped within the pipeline after a predetermined period of contact therewith. In yet another embodiment, a plurality of microflowable devices are injected with a preprogrammed instruction to expose or extend the nanowire and then withdraw it at a specific point in the pipeline wherein each microflowable devices performs this function only once, and the microflowable devices are divided into groups with each group performing this function at a different location within a pipeline.

The method of the present invention can be used to create either a flowing senor array or a static sensor array. The former has been described above. The latter is particularly useful for measuring corrosion as indicated by differential expansion of a pipeline under pressure. In this mode, a sensor array is created by dispersing the microflowable devices along the length of the pipeline, and then the flow in the pipeline is stopped. A pressure wave is then created within the pipeline and data indicative of the variation in pressure is collected along the pipeline as the pressure wave travels the length of the pipeline. At the conclusion of the test, the pipeline is restated with only a very short delay in transmission of fluid in the pipeline. In both this embodiment and an embodiment wherein the microflowable devices are flowing during data collection, the array of microflowable devices functions as a sensor array which can be used to build a profile relating to a parameter of interest along a length of the pipeline.

Whether the microflowable devices are used to create a flowing sensor array or a static sensor array, they must be distributed along the pipeline. This can be accomplished in at least two ways. In one embodiment of the method of the present invention, the microflowable devices are injected into the pipeline all at once. In this method, a variety of microflowable devices are used such that some characteristic of the microflowable devices causes them to distribute themselves along the pipeline in numbers sufficient to adequately measure the parameter of interest to be measured. The characteristics causing the microflowable devices to be distributed rather than flow as a plug can be any, including such simple measures as varying density to the complex such as a magnetic attachment device and a timer to activate same.

A more preferred method of distributing the microflowable devices of the present invention is to inject them into the pipeline at a fixed rate over a period of time sufficient to carry them the length of the pipeline to measured. This can be done with an automatic metered injection device and is preferred. In an alternative method, the devices can be suspended in a matrix that dissolves with time in the fluid being transported in the pipeline. In this embodiment, the matrix is placed into the pipeline and the microflowable devices are released as the matrix dissolves.

While the foregoing disclosure is directed to the preferred embodiments of the invention, various modifications will be apparent to those skilled in the art. It is intended that all variations within the scope of the appended claims be embraced by the foregoing disclosure.

What is claimed is:

1. A method for utilizing microflowable devices for pipeline inspections comprising:

(a) injecting a plurality of microflowable devices into a pipeline containing a moving fluid, (b) allowing the plurality of microflowable devices to pass through a portion of the pipeline, collecting data regarding a parameter of interest relating to the pipeline, and (c) recovering the data regarding the parameter of interest, wherein the flow of the moving fluid is stopped during the period when the data is collected.

2. A pipeline inspection system including a plurality of microflowable devices, an injection point, and a device that can be used by the microflowable devices to sense location within a pipeline, wherein the microflowable device is capable of collecting data regarding a parameter of interest relating to the pipeline and the system is capable of injecting the plurality of microflowable devices and the plurality of microflowable devices can form either a flowing sensor array or a static sensor array.

3. The pipeline inspection system of claim 2 further comprising a source of microflowable devices, an injection device, and an extraction tube.

4. The pipeline inspection system of claim 2 wherein the plurality of microflowable devices further comprises a nanowire sensor.

5. The pipeline inspection system of claim 2 wherein the device which can be used by the plurality of microflowable devices to sense location within the pipeline is a permanent magnet.

6. A method for utilizing microflowable devices for pipeline inspections comprising:

(a) injecting a plurality of microflowable devices into a pipeline containing a moving fluid, (b) allowing the plurality of microflowable devices to pass through a portion of the pipeline, collecting data regarding a parameter of interest relating to the pipeline and sensing its location within the pipeline using at least one of (i) time from injection and (ii) proximity to a device used by the microflowable devices to sense location within the pipeline, and (c) recovering the data regarding the parameter of interest;

wherein the flow of the moving fluid is stopped during the period when the data is collected.

7. A method for utilizing microflowable devices for pipeline inspections comprising:

(a) injecting a plurality of microflowable devices into a pipeline containing a moving fluid, (b) allowing the plurality of microflowable devices to pass through a portion of the pipeline, collecting data regarding a parameter of interest relating to the pipeline and sensing its location within the pipeline using at least one of (i) time from injection and (ii) proximity to a device used by the microflowable devices to sense location within the pipeline, and (c) recovering the data regarding the parameter of interest;

wherein the plurality of microflowable devices form either a flowing sensor array or a static sensor array.

8. The method of claim 7 further comprising abandoning at least one of the plurality of microflowable devices in the pipeline.

9. The method of claim 7 further comprising collecting and removing at least one of the plurality of microflowable devices from within the pipeline.

10. The method of claim 9 wherein the step of recovering the data regarding the parameter of interest is done prior to collecting and removing the at least one of the plurality of microflowable devices from within the pipeline.

11. The method of claim 7 wherein the recovery of data is done using electromagnetic signals.

12. The method of claim 7 wherein the parameter of interest relating to the pipeline is at least one of: pressure, temperature, flow rate, viscosity, composition of the fluid, presence of a particular chemical or ion, water saturation, composition, corrosion, and vibration.

13. The method of claim 12 wherein the parameter of interest relating to the pipeline comprises pressure.

14. The method of claim 13 further comprising determining from pressure changes and location of the pressure changes within the pipeline, corrosion of a pipeline wall.

15. The method of claim 14 further comprising performing maintenance on a pipeline based on the determination of corrosion of a pipeline wall.

16. The method of claim 12 further comprising determining from the presence of the particular chemical or ion and location within the pipeline of the particular chemical or ions, pipeline stress.

17. The method of claim 16 further comprising performing maintenance on a pipeline based on the determination of pipeline stress.

18. The method of claim 7 further comprising treating a pipeline with a detection enhancement agent prior to or concurrent with injecting the plurality of microflowable device.

19. The method of claim 7 wherein the data collected is used to prepare a profile of the portion of the pipeline.

20. The pipeline inspection system of claim 7 wherein the plurality of microflowable devices further comprises a plurality of microflowable devices encapsulated in a material that is suitable for the pipeline environment, and the plurality of microflowable devices includes one or more of: a sensor element, a control circuit or controller, a memory unit, and a resident power supply.

* * * * *